US005481771A

United States Patent [19]

Burk, IV

[11] Patent Number: 5,481,771

[45] Date of Patent: Jan. 9, 1996

[54] TENSION ELIMINATOR PILLOW

[76] Inventor: John L. Burk, IV, 1906 S. First, Austin, Tex. 78704

[21] Appl. No.: 332,843

[22] Filed: Nov. 1, 1994

[51] Int. Cl.[6] ..... A47C 20/02

[52] U.S. Cl. ..... 5/636; 5/481; 5/490

[58] Field of Search ..... 5/636, 637, 644, 5/481, 490; D6/601

[56] References Cited

U.S. PATENT DOCUMENTS

| | | | |
|---|---|---|---|
| D. 216,689 | 3/1970 | Isogai | D6/601 |
| D. 237,569 | 11/1975 | DeRue | 5/636 |
| D. 247,312 | 2/1978 | Zeiss | D6/601 |
| D. 291,396 | 8/1987 | Smith | 5/636 |
| 2,589,155 | 3/1952 | Smith | 5/637 |
| 2,958,769 | 11/1960 | Bounds | D6/601 |
| 3,648,308 | 3/1972 | Greenawalt | D6/601 |
| 3,981,032 | 9/1976 | Brooks | 5/636 |
| 4,034,787 | 7/1977 | Ellis | 5/636 |
| 4,042,278 | 8/1977 | Jensen | 5/636 |
| 4,679,263 | 7/1987 | Honer | 5/636 |

*Primary Examiner*—Michael J. Milano

[57] ABSTRACT

A tension eliminator pillow comprising a block in a generally rectangular configuration having an upper surface, a lower surface, long side walls and short front and rear walls coupled therebetween in a generally rectangular configuration, the side walls, front wall and rear wall being planar in configuration, the lower surface also being planar in configuration; two hemispherically shaped projections symmetrically disposed on opposite sides of a center line midway between the side walls, the walls extending upwardly a distance; the projections being located adjacent to the front wall of the pillow within the lower half of the pillow; and a U-shaped projection symmetrically formed in the central extent of the block, the projection being smoothly curved throughout its extent, the projection having parallel side edges parallel with the side walls, the projection terminating in a curved portion adjacent to the rear wall of the block with the projection initiating adjacent to the hemispherical projections.

4 Claims, 4 Drawing Sheets

TENSION ELIMINATOR PILLOW

BACKGROUND OF THE INVENTION

1. Field of the Invention

The present invention relates to a tension eliminator pillow and more particularly pertains to eliminating tension through a pillow configured for optimizing relaxation and minimizing tension.

2. Description of the Prior Art

The use of pillows of a wide variety of designs and configurations is known in the prior art. More specifically, pillows of a wide variety of designs and configurations heretofore devised and utilized for the purpose of increase the comfort of a person employing a pillow as a headrest through a wide variety of methods and apparatuses are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,726,087 a contoured-head and neck foam pillow.

U.S. Pat. No. 4,956,886 discloses a self adjustable neck support pillow.

U.S. Pat. No. 4,996,734 discloses a T-shaped pillow with neck supporting portion.

U.S. Pat. No. 5,123,132 discloses an additional type of pillow.

U.S. Pat. No. 5,205,611 discloses another head support pillow.

In this respect, the tension eliminator pillow according to the present invention substantially departs from the conventional concepts and designs of the prior art, and in doing so provides an apparatus primarily developed for the purpose of eliminating tension through a pillow configured for optimizing relaxation and minimizing tension.

Therefore, it can be appreciated that there exists a continuing need for a new and improved tension eliminator pillow which can be used for eliminating tension through a pillow configured for optimizing relaxation and minimizing tension. In this regard, the present invention substantially fulfills this need.

SUMMARY OF THE INVENTION

In view of the foregoing disadvantages inherent in the known types of pillows of a wide variety of designs and configurations now present in the prior art, the present invention provides an improved tension eliminator pillow. As such, the general purpose of the present invention, which will be described subsequently in greater detail, is to provide a new and improved tension eliminator pillow and method which has all the advantages of the prior art and none of the disadvantages.

To attain this, the present invention essentially comprises a new and improved tension eliminator pillow comprising, in combination, a block in a generally rectangular configuration having an upper surface, a lower surface, long side walls and short front and rear walls coupled therebetween in a generally rectangular configuration, the side walls, front wall and rear wall being planar in configuration, the lower surface also being planar in configuration; two hemispherically shaped projections symmetrically disposed on opposite sides of a center line midway between the side walls, the projections extending upwardly a distance of between about 50 and 75 percent of the height of the side walls, the projections being located adjacent to the front wall of the pillow within the lower half of the pillow; a U-shaped projection symmetrically formed in the central extent of the block, the projection being smoothly curved throughout its extent, the projection having parallel side edges parallel with the side walls with the projection constituting between about 50 and 75 percent of the lateral extent of the block measured from side wall to side wall, the projection terminating in a curved portion adjacent to the rear wall of the block with the projection initiating adjacent to the hemispherical projections and constituting between about 60 and 80 percent of the length of the block measured from front wall to rear wall; the projections and portion of the block therebeneath being fabricated of a firm closed-cell polyurethane foam, the central extent of the block beneath the U-shaped projection being fabricated of a medium firm closed-cell polyurethane foam, and the periphery of the block around the hemispherical projection and U-shaped projection being fabricated of a soft closed-cell polyurethane foam; and a pillowcase formed in a generally rectangular configuration with parallel side walls and parallel front and rear walls, in a rectangular configuration and with a planar lower surface coextensive with the planar lower surface of the block and with an upper surface generally planar in configuration except in the area over the projections where the pillow case is enlarged with the projections, the pillow case also including an opening with a zipper across the central extent of the rear wall and extending a small distance into the side walls adjacent thereto.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved tension eliminator pillow which has all the advantages of the prior art pillows of a wide variety of designs and configurations and none of the disadvantages.

It is another object of the present invention to provide a new and improved tension eliminator pillow which may be easily and efficiently manufactured and marketed.

It is further object of the present invention to provide a new and improved tension eliminator pillow which is of durable and reliable construction.

An even further object of the present invention is to provide a new and improved tension eliminator pillow which is susceptible of a low cost of manufacture with regard to both materials and labor, and which accordingly is then susceptible of low prices of sale to the consuming public, thereby making such tension eliminator pillow economically available to the buying public.

Still yet another object of the present invention is to provide a new and improved tension eliminator pillow which provides in the apparatuses and methods of the prior art some of the advantages thereof, while simultaneously overcoming some of the disadvantages normally associated therewith.

Still another object of the present invention is to eliminate tension through a pillow configured for optimizing relaxation and minimizing tension.

Lastly, it is an object of the present invention to provide a new and improved tension eliminator pillow comprising a block in a generally rectangular configuration having an upper surface, a lower surface, long side walls and short front and rear walls coupled therebetween in a generally rectangular configuration, the side walls, front wall and rear wall being planar in configuration, the lower surface also being planar in configuration; two hemispherically shaped projections symmetrically disposed on opposite sides of a center line midway between the side walls, the walls extending upwardly a distance; the projections being located adjacent to the front wall of the pillow within the lower half of the pillow; and a U-shaped projection symmetrically formed in the central extent of the block, the projection being smoothly curved throughout its extent, the projection having parallel side edges parallel with the side walls, the projection terminating in a curved portion adjacent to the rear wall of the block with the projection initiating adjacent to the hemispherical projections.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
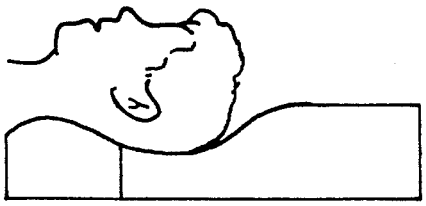
PRIOR ART Fig. 1
FIG. 1 is a side elevational view of a pillow designed in accordance with a prior art construction.
Figure 2:
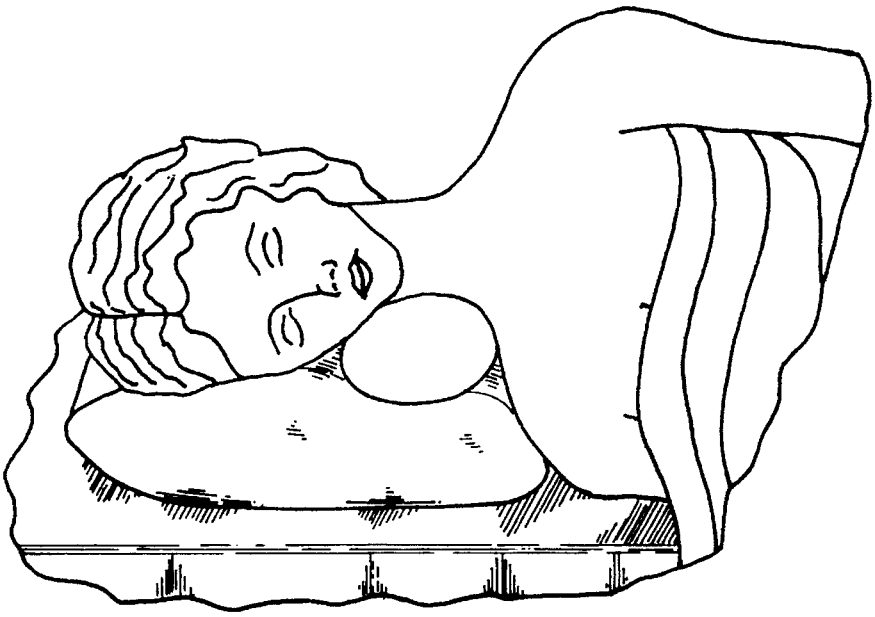
PRIOR ART Fig. 2
FIG. 2 is another pillow of a prior art construction.
Figure 3:
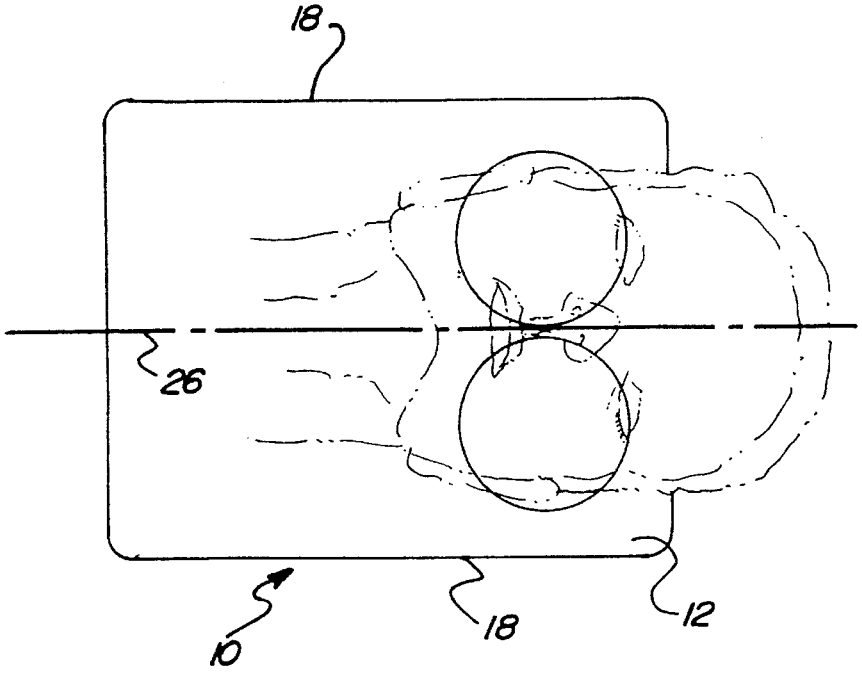
FIG. 3 is a top view of the preferred embodiment of the tension eliminator pillow constructed in accordance with the principles of the present invention.
Figure 4:
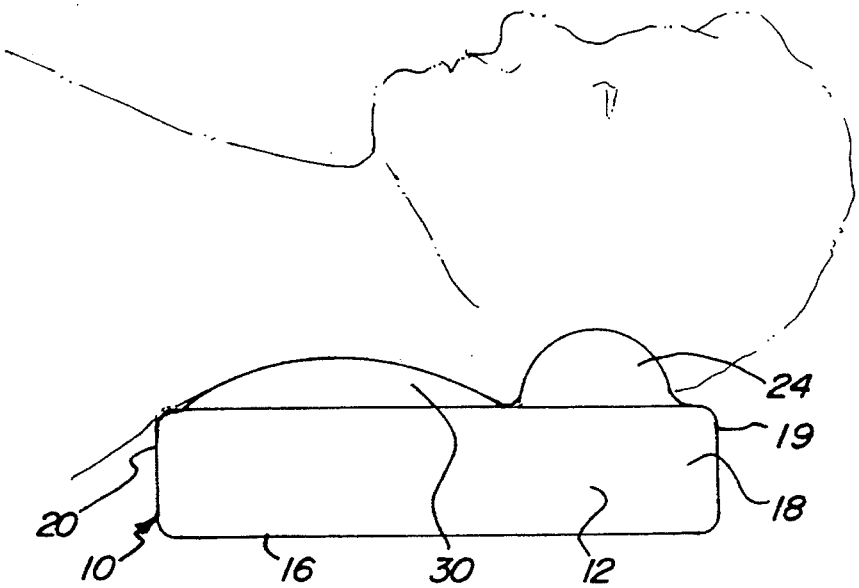
FIG. 4 is side elevational view of the pillow shown in FIG. 3.
Figure 5:
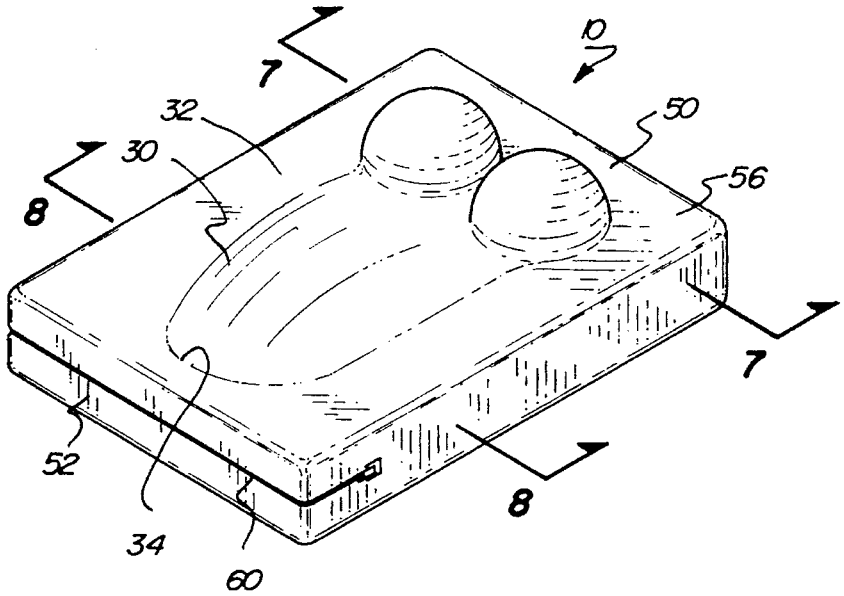
FIG. 5 is a perspective view of the pillow shown in FIGS. 3 and 4.
Figure 6:
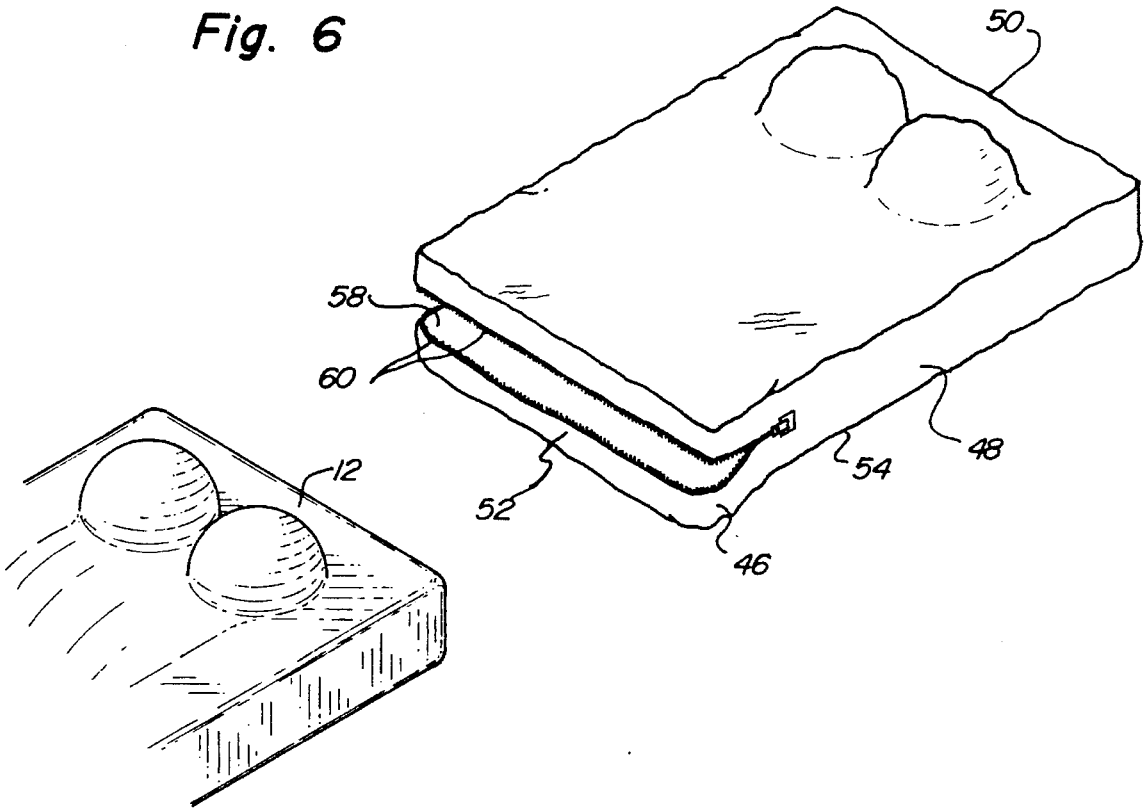
FIG. 6 is a exploded perspective view of the apparatus shown in FIG. 5.
Figure 7:
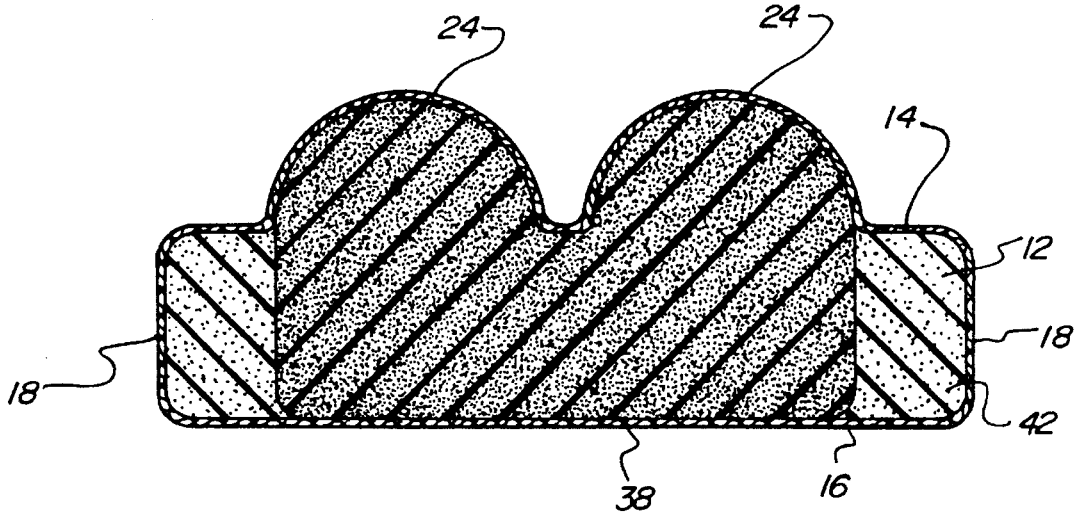
FIG. 7 is a cross-sectional view taken along line 7—7 of FIG. 5.
Figure 8:
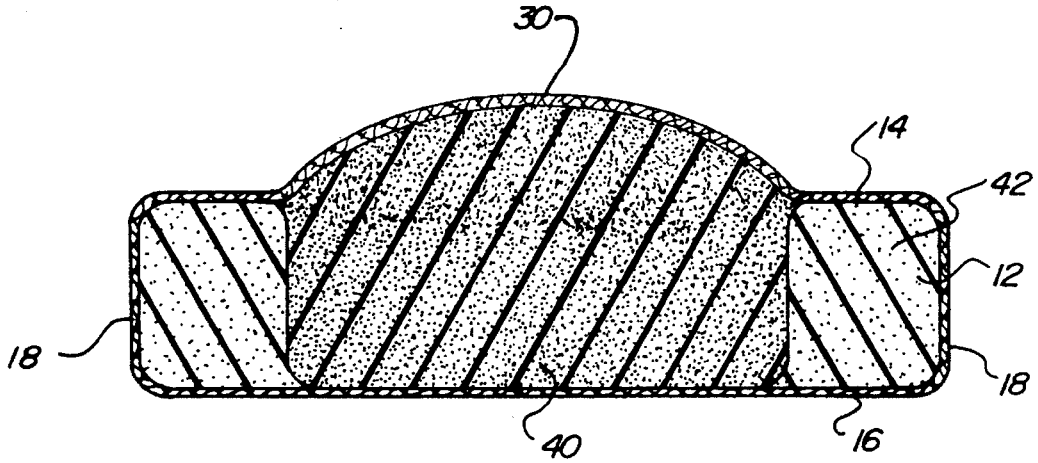
FIG. 8 is a cross-sectional view taken along line 8—8 of FIG. 5.

With reference now to the drawings, and in particular to FIG. 3 thereof, the preferred embodiment of the new and improved tension eliminator pillow embodying the principles and concepts of the present invention and generally designated by the reference numeral 10 will be described.

The present invention, the new and improved tension eliminator pillow is comprised of a plurality of components. Such components include a block, two projections, a recess, and a pillowcase. Such components are individually configured and correlated with respect to each other so as to attain the desired objective.

The central component of the system 10 of the present invention is a block 12. The block is in a generally rectangular configuration. It has an upper surface 14 and a lower surface 16. It also has long side walls 18 and short front and rear walls 19 and 20 coupled between the side walls. Together the walls form a generally rectangular box-like configuration. The side walls, front wall and rear wall are all in a generally planar configuration. The lower surface is in a generally liner configuration.

Formed in the upper surface are a pair of hemispherically-shaped projections 24. Such projections are symmetrically disposed on opposite sides of a center line 26, the center line lying midway between the side walls. The projections extend upwardly a distance of between about fifty percent and seventy-percent the height of the side walls. The projections are located adjacent to the front wall of the pillow within the lower half of the pillow.

Next provided is a U-shaped projection 30. Such projection is symmetrically formed in the central extent of the block. The projection is smoothly curved downwardly within the block throughout its entire extent. The projection has parallel side edges 32 which are parallel with the side walls. The projection constitutes between about fifty percent and seventy-five percent of the lateral extent of the block. Such lateral extent is measured from side wall to side wall. The projection terminates in a curved portion 34. Such curved portion is adjacent to the rear wall of the block. The projection initiates adjacent to the hemispherical projections and when measured along the central axis, constitutes between about sixty percent and eighty percent of the length of the block. Such length is measured from the front wall to the rear wall.

It is preferred that the projection and portion of the block therebeneath are fabricated of a firm closed-cell foam 38, preferably polyurethane. The central extent of the block beneath the U-shaped projection is fabricated of a medium firm closed-cell foam 40, preferably polyurethane. The periphery of the block around the hemispherical projection and U-shaped projection are fabricated of a soft closed-cell foam 42, preferably polyethylene.

The final component of the system 10 is a pillowcase 46. Such pillowcase is formed in a generally rectangular configuration. It has parallel side walls 48 adapted to overlie the side walls of the block. It has parallel front and rear walls 50 and 52 in a rectangular configuration adapted to overlie the front and rear walls of the block. It also has a planar lower surface 54 essentially coextensive with the planar lower surface of the block. It also has an upper surface 56 generally planar throughout the majority of its configuration except in the area over the projections where the pillowcase is enlarged to accommodate the projections. Here again the shape of the pillowcase corresponds to overlie the shape of the block on the upper surface.

The pillowcase also includes an opening 58 with a sliding fastener 56 such as a zipper, pile-type fastener, or the like located across the central extent of the rear wall. The opening end fastener extend a small distance from the side walls adjacent thereto. This allows for the removal of the pillowcase for washing purposes.

The present invention is a neck support pillow that applies pressure at the base of the skull and neck muscles to relieve tension headaches or relax strained or overworked muscles. The shape of the pillow is designed to fit the curvature of the neck, and is made from dense, solid foam. Two pressure spheres the size of tennis balls are built into one end of the pillow. A softer, more supple foam fills the narrower mid-section of the interior of the pillow. Additional soft foam surrounds the pressure spheres and mid-section creating a rectangular pillow. The entire unit is covered with a nylon material which could be produced in a wide variety of colors and is designed to fit any user.

When the user has a tension headache, or just wishes to relax the neck muscles, the present invention is placed on the back of the neck with the two pressure spheres positioned at the base of the skull. The user then relaxes his or her head slightly back making sure that the pillow is between the neck and another surface, for example, a chair, bed, etc. The two pressure spheres should remain on the two sides at the base of the skull. Since the pressure points are being supported by the pillow, the neck muscles are allowed to relax, thus relieving the tension of the muscles and the headache.

A lightweight and portable unit, the present invention can be conveniently transported and used. The nylon covering is durable and washable and effectively eases painful tension headaches without the use of unnecessary medication.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved tension eliminator pillow comprising, in combination:

a block in a generally rectangular configuration having an upper surface, a lower surface, long side walls and short front and rear walls coupled therebetween in a generally rectangular configuration, the side walls, front wall and rear wall being planar in configuration, the lower surface also being planar in configuration;

two hemispherically-shaped projections symmetrically disposed on opposite sides of a center line midway between the side walls, the hemispherical projections extending upwardly a distance of between about 50 and 75 percent of the height of the side walls, the hemispherical projections being located adjacent to the front wall of the pillow within the lower half of the pillow;

a U-shaped projection symmetrically formed in the central extent of the block, the U-shaped projection being smoothly curved throughout its extent, the U-shaped projection having parallel side edges parallel with the side walls with the shaped projection constituting between about 50 and 75 percent of the lateral extent of the block measured from side wall to side wall, the U-shaped projection terminating in a curved portion adjacent to the rear wall of the block with the U-shaped projection initiating adjacent to the hemispherical projections and constituting between about 60 and 80 percent of the length of the block measured from front wall to rear wall;

the hemispherical projections and portion of the block therebeneath being fabricated of a firm closed-cell polyurethane foam, the central extent of the block beneath the U-shaped projection being fabricated of a medium firm closed-cell polyurethane foam, and the periphery of the block around the hemispherical projections and U-shaped projection being fabricated of a soft closed-cell polyurethane foam; and a pillowcase formed in a generally rectangular configuration with parallel side walls and parallel front and rear walls, in a rectangular configuration and with a planar lower surface coextensive with the planar lower surface of the block and with an upper surface generally planar in configuration except in the area over the hemispherical projections and U-shaped projection where the pillow case is enlarged by all the projections, the pillow case also including an opening with a zipper across the central extent of the rear wall and extending a small distance into the side walls adjacent thereto.

2. A tension eliminator pillow comprising:

a block in a generally rectangular configuration having an upper surface, a lower surface, long side walls and short front and rear walls coupled therebetween in a generally rectangular configuration, the side walls, front wall and rear wall being planar in configuration, the lower surface also being planar in configuration;

two hemispherically shaped projections symmetrically disposed on opposite sides of a center line midway between the side walls, the walls extending upwardly a distance;

the hemispherical projections being located adjacent to the front wall of the pillow within the lower half of the pillow; and a U-shaped projection symmetrically formed in the central extent of the block, the U-shape projection being smoothly curved throughout its extent, the U-shape projection having parallel side edges parallel with the side walls, the U-shaped projection terminating in a curved portion adjacent to the rear wall of the block with the U-shaped projection initiating adjacent to the hemispherical projections and the hemispherical projections, the U-shaped projection and portion of the block therebeneath are fabricated of a firm closed-cell polyurethane foam.

3. The pillow as set forth in claim 2 wherein the central extent of the block beneath the U-shaped projection being fabricated of a medium firm closed-cell polyurethane foam, and the periphery of the block around the hemispherical projection and U-shaped projection being fabricated of a soft closed-cell polyurethane foam.

4. The pillow as set forth in claim 2 and further including:

a pillowcase formed in a generally rectangular configuration with parallel side walls and parallel front and rear walls, in a rectangular configuration and with a planar lower surface coextensive with the planar lower surface of the block and with an upper surface generally planar in configuration except in the area over the hemispherical projections and U-shape projection where the pillow case is enlarged by all the projections, the pillow case also including an opening with a zipper across the central extent of the rear wall and extending a small distance into the side walls adjacent thereto.

* * * * *